US006292558B1

(12) United States Patent
Smith

(10) Patent No.: US 6,292,558 B1
(45) Date of Patent: Sep. 18, 2001

(54) TELEPHONE NETWORK INTERFACE APPARATUS

(75) Inventor: Thomas J. Smith, Bay Shore, NY (US)

(73) Assignee: TII Industries, Inc., Copiague, NY (US)

( * ) Notice: Subject to any disclaimer, the term of this patent is extended or adjusted under 35 U.S.C. 154(b) by 0 days.

(21) Appl. No.: 08/287,505

(22) Filed: Aug. 8, 1994

Related U.S. Application Data

(63) Continuation of application No. 08/140,481, filed on Oct. 25, 1993, now abandoned, which is a continuation of application No. 07/650,170, filed on Feb. 4, 1991, now abandoned, which is a continuation of application No. 07/390,397, filed on Aug. 4, 1989, now abandoned, which is a continuation-in-part of application No. 06/627,677, filed on Jan. 6, 1987, now Pat. No. Des. 287,583.

(51) Int. Cl.[7] ..... H01R 33/54
(52) U.S. Cl. ..... 379/399; 379/412; 379/442
(58) Field of Search ..... 379/399, 412, 379/442; 361/358; D14/52

(56) References Cited

U.S. PATENT DOCUMENTS

| | | | | |
|---|---|---|---|---|
| D. 287,583 | * | 1/1987 | Smith et al. | D14/52 |
| D. 347,229 | | 5/1994 | Smith | D14/240 |
| 4,488,008 | * | 12/1984 | Dellinger et al. | 379/412 |
| 4,518,084 | * | 5/1985 | Berkman | 206/387 |
| 4,522,326 | * | 6/1985 | Tuohy, III | 224/310 |
| 4,531,774 | * | 7/1985 | Whatley | 296/37.6 |
| 4,562,311 | * | 12/1985 | Dola | 379/412 |
| 4,741,032 | * | 4/1988 | Hampton | 379/399 |
| 4,800,588 | * | 1/1989 | Poster, Jr. | 379/399 |
| 4,853,960 | | 8/1989 | Smith | 379/437 |

* cited by examiner

*Primary Examiner*—Ahmad Matar
(74) *Attorney, Agent, or Firm*—Martin Sachs

(57) ABSTRACT

A telephone network interface apparatus for use in the subscriber loop of a telephone transmission system, i.e., connected to a non-telephone company owned premise wiring (a consumer household) and a telephone company owned portion of such loop at the junction where the two connect to each other. The apparatus provides limited access to the open top base member, i.e., only a portion of the base member is made readily accessible to the consumer by providing a cover readily opened by him and a shield cover which may be readily opened by telephone company employees in order to provide access to electronic components owned by the telephone company disposed with the base member. Both covers are free of apertures communicating with the inside of he base member. The device includes a base structure which includes a first and second set of terminals and a plug and receptacle arrangement for disconnecting the premises wiring from the telephone transmission system. The first set of terminals and the plugs and receptacles are accessible to the consumer and access is denied to the remaining portion of the base member which includes a second set of terminals and a plurality of electronic components, unless opened by a telephone company employee having the proper tool therefor. The apparatus is provided with an invasive free cover to protect the internal components from water condensation.

15 Claims, 4 Drawing Sheets

TELEPHONE NETWORK INTERFACE APPARATUS

The present application is a continuation of U.S. Ser. No. 08/140,481 filed Oct. 25, 1993 Abandoned; which is a continuation of U.S. Ser. No. 07/650,170 filed Feb. 4, 1991 (Abandoned) which is a continuation of application U.S. Ser. No. 07/390,397 filed Aug. 4, 1989 (Abandoned) which is a continuation in part of U.S. Ser. No. 06/627,677 issued Jul. 5, 1984 is now Patent No. D287,583 issued on Jan. 6, 1987.

BACKGROUND OF THE INVENTION

1. Field of the Invention

The present invention relates to telephone network interface devices, and in particular, relates to a telephone interface apparatus that has a cover free from apertures having access to the inside and is suitable for connection between the premise wiring of a subscriber loop of a telephone transmission system at the junction where it connects to the telephone company owned portion of the subscriber loop.

2. Discussion of the Relevant Art

With changes in the law permitting the individual homeowner to purchase and install his own telephone equipment and related appliances he became responsible for the proper operation of the equipment he installed. The telephone company no longer owned the equipment in a subscriber's home and became responsible only for proper service up to the juncture between the telephone lines and the homeowner's premises. Thus, it became necessary to provide a telephone interface apparatus which was capable of readily disconnecting the homeowner's wiring installed in the premises from the telephone company's transmission lines so that when trouble occurred, it could readily be isolated to the telephone company's line or the homeowner's house wiring. If a homeowner experienced a problem with his telephone service it was first necessary for him to determine if it was the telephone company that needed a repair on their lines or equipment or if the wiring or equipment in the homeowner installed apparatus required repair. Many devices became available on the market which provided the function of readily disconnecting the home wiring from the telephone company owned portion of the subscriber loop. Typical of these apparatuses is U.S. Pat. No. 4,488,008 issued to T. A. Dellinger et al on Dec. 11, 1984. Another device typical of these apparatuses is U.S. Pat. No. Des. 282,654 issued to S. B. Perry et al on Feb. 18, 1986.

These devices although providing the necessary function of severing the telephone company owned portion of the subscriber loop from the homeowner's portion of the subscriber loop are inconvenient, and are not free of apertures communicating with the base member, and the instant invention provides a simple convenient means to provide a similar function. The shortcomings of the prior art are overcome and isolation between the components, terminals and circuitry which is maintained by the telephone company is readily separated from and made non-accessible to the subscribing homeowner. Yet, access to the terminals to which the subscriber must connect his equipment is made readily available and is protected by a covering so that the internal components are protected from the elements.

SUMMARY OF INVENTION

It is an object of the present invention to provide a telephone network interface apparatus which may readily be mounted by the telephone company at the juncture where the subscriber loop becomes the property of the homeowner (subscriber) and the remaining portion remains the property of the telephone company.

It is another object of the present invention to provide a telephone network interface apparatus capable of containing within the housing the necessary electronic components needed by the telephone company at the juncture of the homeowner's premises and the telephone company's transmission lines.

It is still yet another object of the present invention to provide a limited access apparatus where the homeowner (subscriber) has access only to the terminals to which he must connect his internal house wiring and auxiliary equipment and is not afforded access to the remaining portion of the apparatus in which the telephone company's components are located.

It is still yet another object of the present invention to provide a telephone network interface apparatus in which the homeowner's portion of the subscriber loop may be readily disconnected from the telephone company's portion of the loop and not permit access to voltages which could injure the homeowner or permit him to disconnect the ground connection.

It is still yet another object of the present invention to provide a telephone network interface apparatus having a cover free of apertures communicating with the base member in which the owner of the premises may readily make a connection to the telephone company's transmission lines and still permit the telephone company to have provision for installing additional components and devices without concern that the homeowner would have ready access thereto.

A telephone network interface apparatus providing limited access for the owner of premises having a telephone subscriber loop termination disposed thereon and providing complete access by telephone service employees, according to the principles of the present invention, comprises an open top base member having a circumscribing wall portion including at least two outwardly extending C-shaped portions for receiving an elongated bar member in the open portion thereof. First and second set of terminals are disposed in the base member, the first set of terminals are adapted to be connected to the owner of the premises subscriber loop termination and the second set of terminals are adapted to be connected the telephone company owned portion of the subscriber loop. Mating plug and socket members disposed in the base member have electrical contacts therein adapted to be electrically and mechanically engaged and disengaged with each other. The first set of wires electrically connect the plug to the first set of terminals and a second set of wires electrically connect the socket to the second set of terminals. A cover is provided with at least two outwardly extending bar members adapted to be received by and cooperate with the outwardly extending C-shaped portions of the base member to provide a complete cover free of apertures communicating with the inside of the open top base member. The extending bar members include at least one longitudinally extending protrusion. A shield is provided with a device receiving and cooperating with the bar members extending protrusions and is provided with a portion adapted to cover at least the second set of terminals, but not the first set of terminals.

The foregoing and other objects and advantages will appear from the description to follow. In the description, reference is made to the accompanying drawing which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
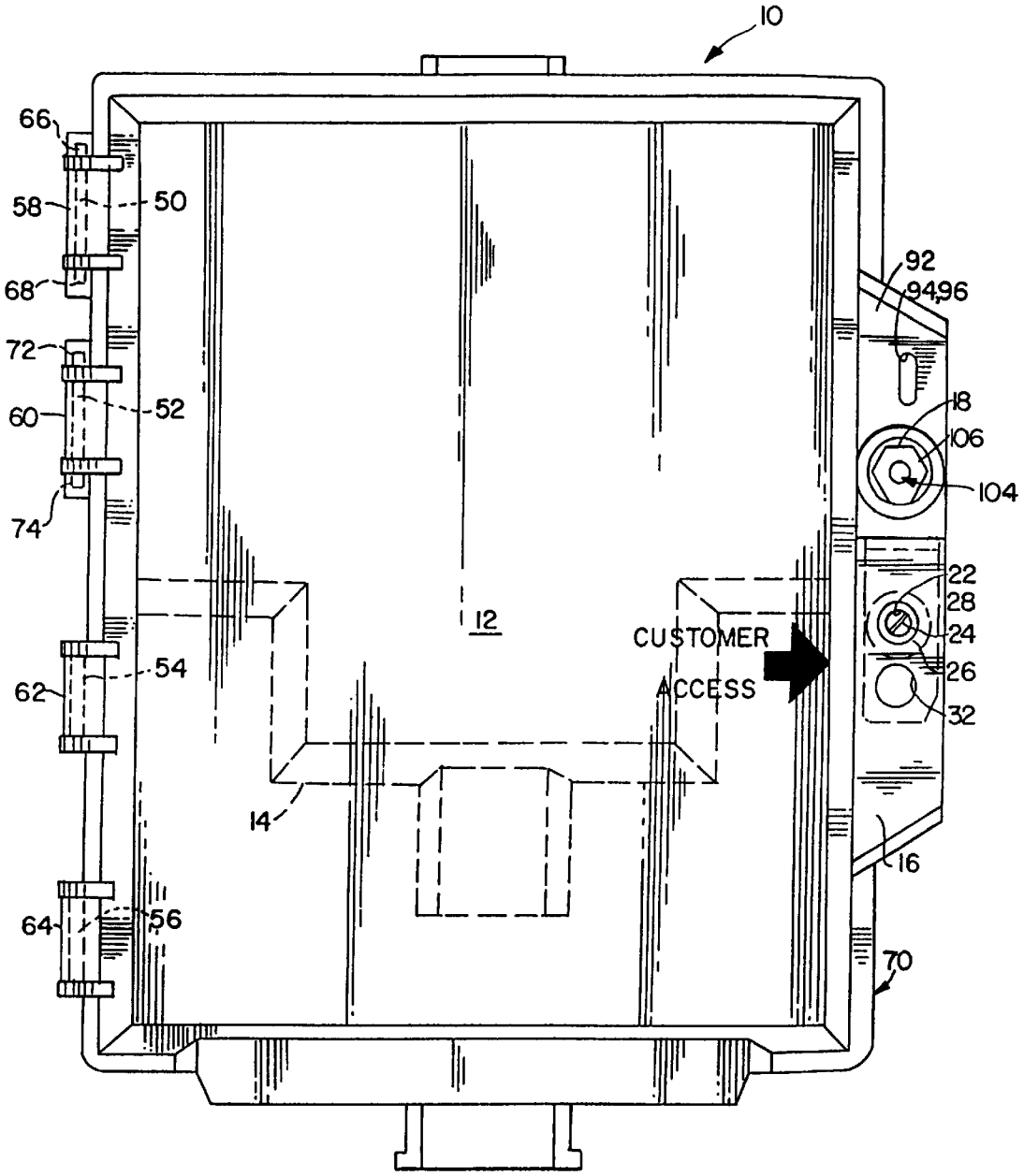
FIG. 1 is a top plan view of a telephone network interface apparatus with its cover closed, according to the principles of the present invention.

Referring now to the figures, and in particular, to FIG. 1, there is shown a telephone network interface apparatus 10, according to the principles of the present invention, that includes a cover member 12, which is free from apertures (invasive free or non-invasive) communicating with the inside of the telephone network interface apparatus 10 and to which is affixed a shield member 14. The manner in which the shield member 14 is affixed to the cover member 12 will be described in detail hereinafter.

The cover member 12 is provided with an extended lip portion 16 which is provided with an aperture 22 adapted to receive a conventional slotted screw 24 therein. Screw 24 is provided with an extended head portion (skirt) 26 which is larger in diameter than the aperture 22 and is received by and adapted to cooperate with threaded aperture 28 provided in the shield lip extension 30 (see FIG. 2). Screw 24 may be removed by a subscriber (owner of the premises) with a conventional screwdriver.

To prevent children or any individual from removing the cover member 12 and doing mischief within the apparatus, a further aperture 32 is provided in the lip portion 16 of cover 12 which coincides with aperture 33 provided in the shield lip extension 30 and into which may be inserted a locking mechanism (not shown) which the subscriber has the means for opening. Thus, the home owner (subscriber) may prevent an unauthorized person from entering or opening the telephone network interface apparatus 10, and gaining access to terminals 34, 36, 38, 40, 42, 44, 46 and 48 to which the telephone subscriber has connected his in-house telephone equipment and auxiliary equipment.

Figure 4:
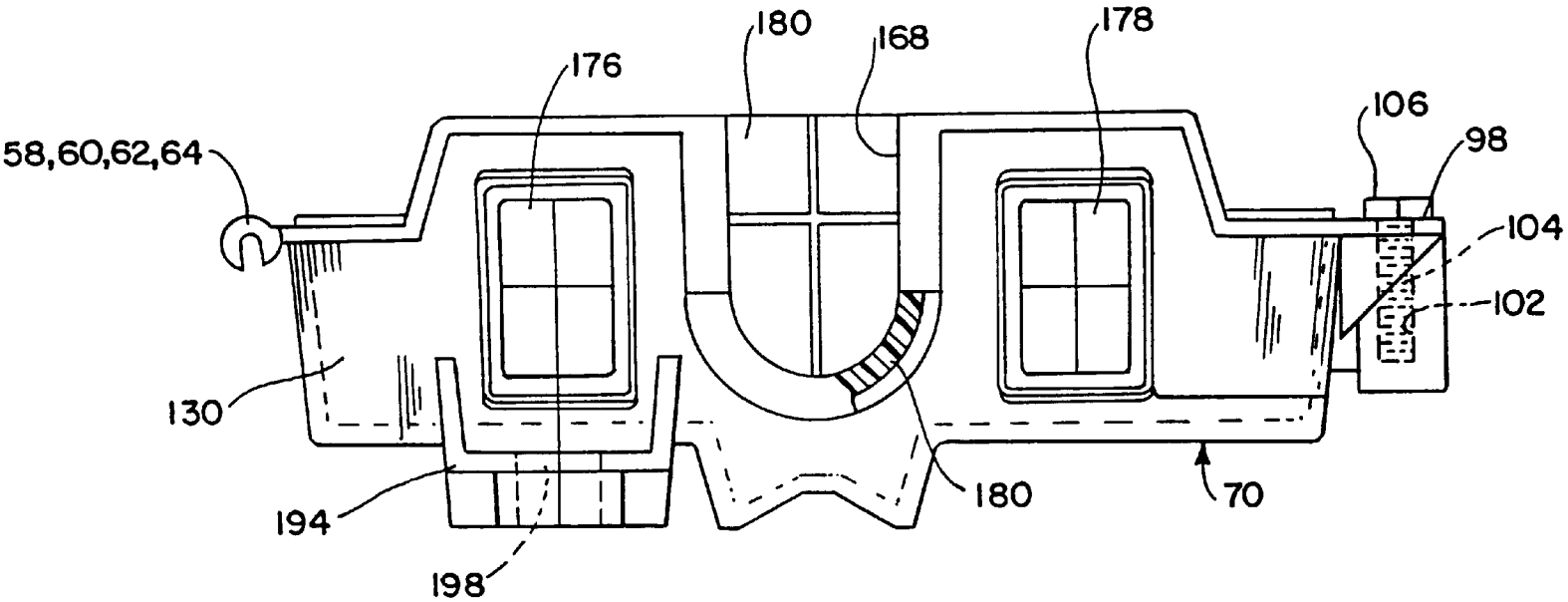
FIG. 4 is an end view in elevation of the base member shown in FIG. 3.

On the opposite edge from lip portion 16, the cover 12 is provided with a plurality of outwardly extending bar members 50, 52, 54, and 56 which are adapted to be received by and cooperate with outwardly extending C-shaped portions 58, 60, 62 and 64 provided on the base member 70 (see FIG. 4).

The extending bar member 50 is provided with longitudinally outwardly extending protrusions 66 and 68. Protrusions 66 and 68 are adapted to be received and cooperate with extending ear portions 76 and 78 that are provided with recesses 84 and 86 provided on shield member 14 (see FIG. 2).

Shield member 14 cannot be installed on base member 70 unless the cover member 12 is affixed thereon because of the unusual hinging arrangement set forth herein. Thus, with the arrangement as described it becomes readily obvious that the shield member 14 cannot be affixed to the base member unless the cover member 12 has been affixed thereon prior thereto.

Shield member 14 also includes a lip portion 92 which is on the opposite edge from the extending ear portions 76 and 78 and is provided with an elongated slot 94 which is positioned to appear directly above and coincide with elongated slot 96 provided on the extending lip portion 98 of base member 70 (see FIG. 4). Thus, it can be seen that any locking mechanism placed through slots 94 and 96 would lock the shield 14 of the telephone network interface 10 so that the shield could not be removed or opened unless the locking mechanism were removed by an employee of the telephone company.

In addition, an aperture 100 is provided in the portion 92 of shield member 14. A threaded aperture 102 is provided in base member 70 which coincides with aperture 100, and is adapted to receive a threaded screw 104, which has a unique shouldered head thereon not usually being received by a conventional tool that may be found in the home. Thus, a mating tool would be given to telephone company employees so that only they could conveniently remove the threaded screw from base member 70. The head 106 of screw 104 has a collar which is larger than the aperture 100 provided in lip 92 of shield 14. Therefore, it is necessary to remove the threaded screw 104 from the base member 70 to gain access to the remaining portion of the base member 70, in addition to any locking mechanism that may be used in conjunction with slots 94 and 96.

It is to be noted that the screws and threaded apertures that lock the cover member 12 to the shield member 14 and base member 20 are all disposed on extending lip portions 16, 30, and 98, respectively, thereby providing an invasive free or non-invasive system which does not provide a water path from the cover through to the base member 70 where it could damage components.

Figure 2:
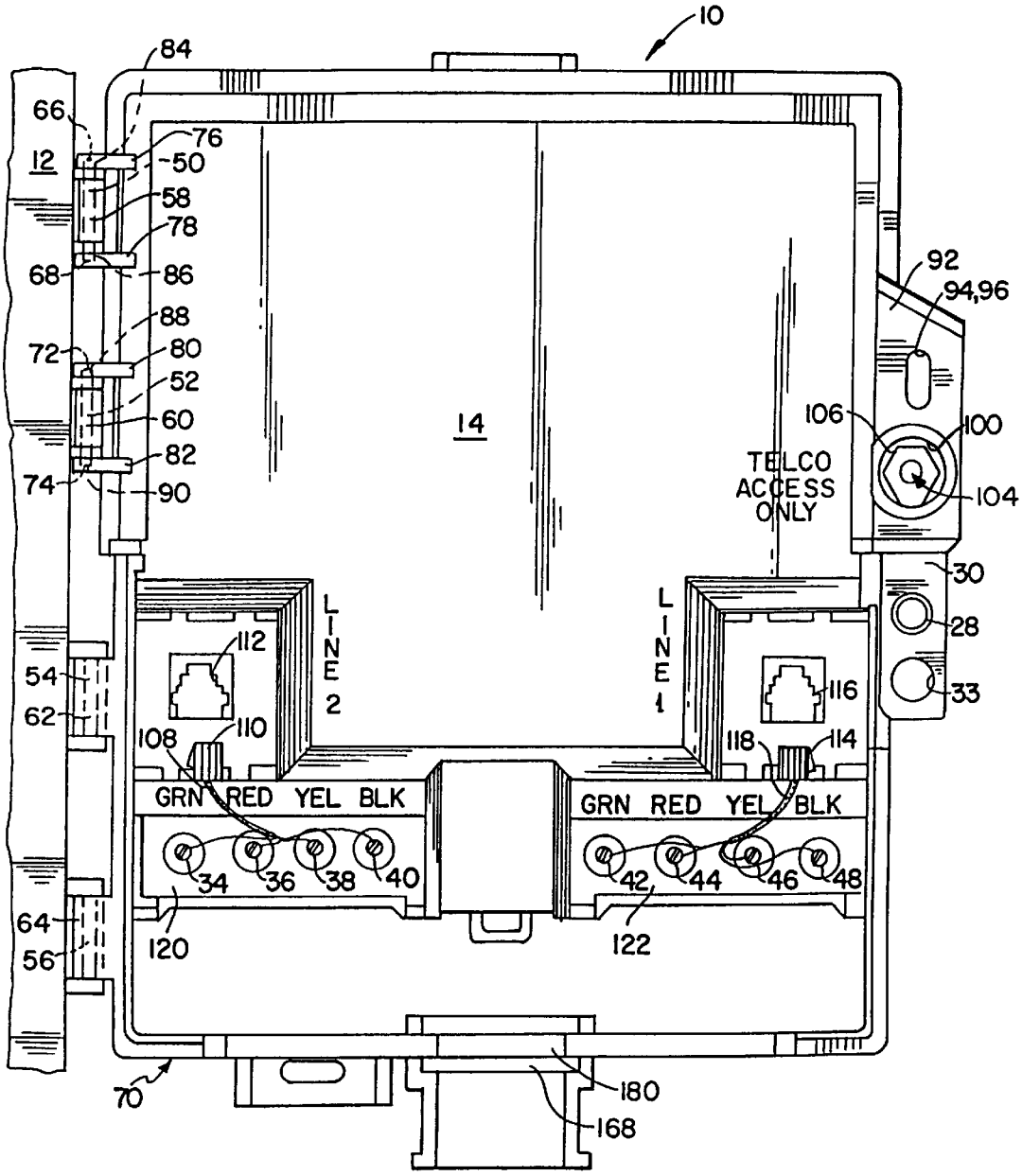
FIG. 2 is a top plan view of the apparatus shown in FIG. 1 with the hinged cover in the open position and the shield member in a closed position.

Referring now to FIG. 2, which shows the cover 12 fully opened on its hinges exposing the terminals 34, 36, 38, 40, 42, 44, 46 and 48 together with cable wire 108, having plug 110 thereon. Plug 110 is adapted to be connected and received into receptacle 112, in a conventional manner. Plug 110 and receptacle 112, is of the conventional well-known type of which reference may be made to U.S. Pat. No. 4,146,292 as well as U.S. Pat. No. 3,990,764 and U.S. Pat. No. 3,761,869 the contents all of which are incorporated herein by reference. Typically plug and jack (receptacle) 112 include four electrical conductors which are suitable for use on a single telephone input line. A similar duplicate arrangement is provided with plug 114, receptacle 116 and cable wire 118.

Thus, as herein disclosed, a telephone network interface suitable for two independent input lines owned by a subscriber may be accommodated. It is not necessary that both lines be used, but a provision has been made in this assembly for a two line subscriber home. All the connections that are to be made by the homeowner (subscriber) are made to terminals 34, 36, 38 and 40 and/or to terminals 42, 44, 46 and 48 if two input lines are to be connected.

The terminal boards or skirt members 120 and 122 are marked with the conventional terminal colors, green, red, yellow and black so that an individual making connections for the first time will be sure and connect the proper colored cable wire to the proper terminal internally. On the reverse side of the terminal boards 120 and 122 the cables 108 and 118 are connected with the plugs 110 and 114 extending to the front side of the terminal boards disposed proximate their respective receptacles 112 and 116. Removing plugs 110 and 114 from their receptacles disconnects all in-house wiring from the telephone company's end of the subscriber's line which are connected to the near ends of receptacles 112 and 116. Thus, if a telephone when plugged into receptacle 112 or 116 operates properly, then it can be assumed that the telephone company's lines are in proper working order and any trouble occurring would be the responsibility of the homeowner (subscriber). As is readily obvious in FIG. 2, the only accessible portion of the telephone network interface apparatus available to the subscriber is the terminals that he requires for connection of the in-house wiring and the telephone plugs 110 and 114 which may be inserted or removed as needed. Access to any other portion of the base member 70 is avoided and any overvoltage protection devices or ringing circuitry, which is included under the shield member 14, is inaccessible to the subscriber. By requiring a special tool necessary to remove the threaded screw 104 and by utilizing a locking device in slots 94 and 96 the security of the device is maintained and only limited access to the interface apparatus is permitted.

Figure 3:
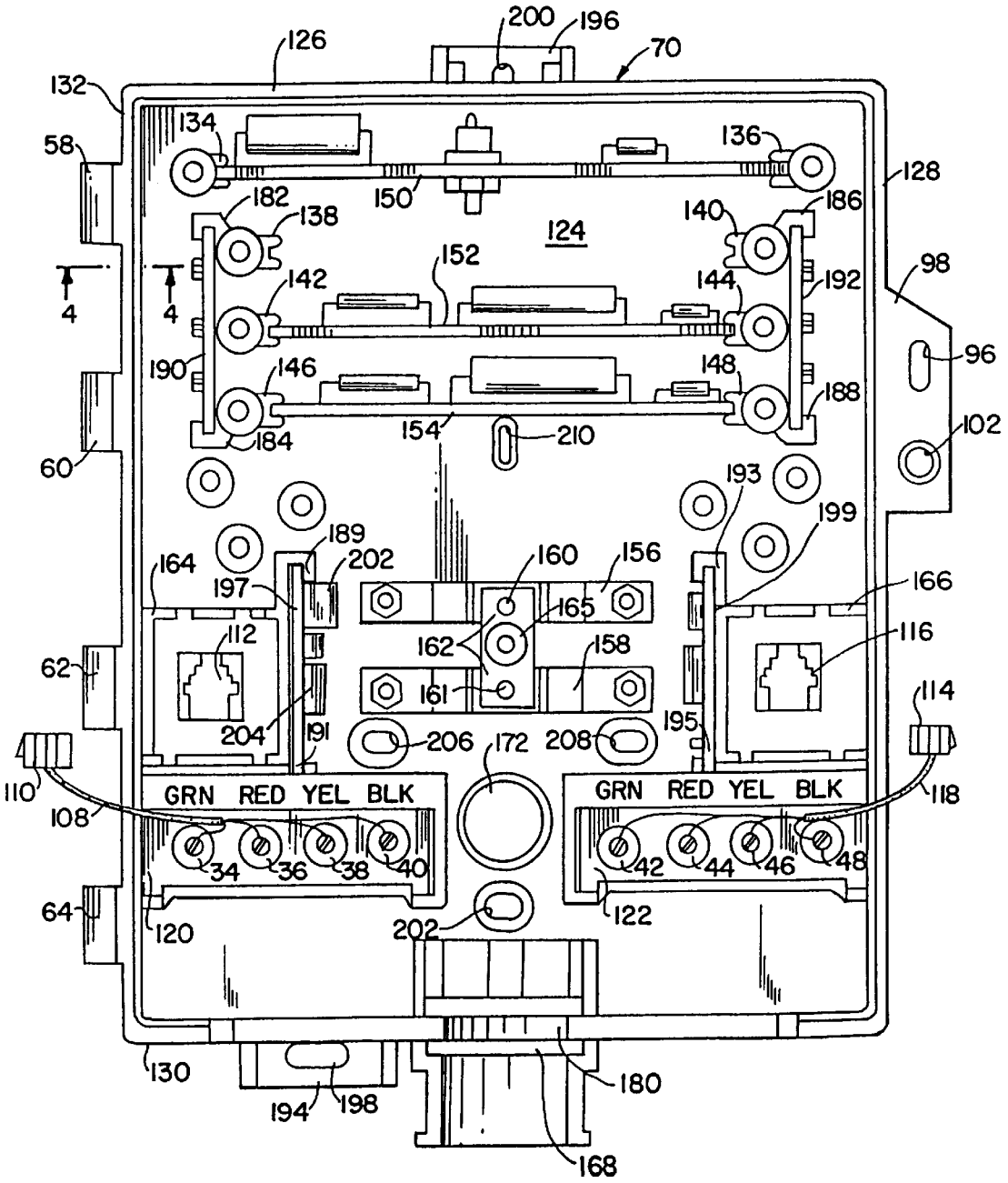
FIG. 3 is a top plan view of the base member of the apparatus as shown in FIG. 1 with the cover and its associated shield member removed.

Referring now to FIG. 3, which shows the base member 70 without the cover member 12 or the shield member 14 thereon. It should be readily apparent that a telephone company employee, desirous of entering the telephone network interface apparatus need only to remove screw 104 and any locking device used by the telephone company (e.g. a seal, etc.), may enter the restricted area of the interface apparatus to service any of the protected (shielded) components.

The base member 70 which includes a flat base portion 124 having circumscribing walls 126, 128, 130 and 132 disposed thereon with an open top. The wall 132, as mentioned earlier, is provided with the C-shaped outwardly extending portions 58, 60, 62 and 64 which are adapted to receive the cover member 12 and its associated shield member 14. A plurality of vertical posts 134, 136, 138, 140, 142, 144, 146 and 148 are disposed in-line at various positions within the base with slots provided therein which are adapted to receive printed circuit assembly boards such as for example boards 150, 152 and 154 on which may be mounted any number of electronic components such as diodes resistors, capacitors, etc. These components are utilized to provide the ringing circuitry and/or the automatic number identification circuitry (ANI) frequently incorporated on subscriber lines. Additionally, the base portion 124 may have disposed thereon mounting for the overvoltage protection devices 156 and 158 with their respective ground terminals 160 and 161 connected in common with the aid of a shorting link(s) 162 to a common ground source 165.

The wiring of the printed circuit boards to their proper locations have not been shown in order to permit the housing to be shown more clearly.

Additionally included is a wall arrangement 164 and 166, having slots disposed therein for easily mounting of the sockets (receptacles) 112 and 116 therein. Thus, it can be readily seen that the base portion 124 is not divided into any particular compartment arrangement but isolation between the subscriber terminals and remaining circuitry is accomplished by utilizing the shield member 14 together with the cover member 12.

Access to the base member 70 may be obtained by entering opening 168 provided in wall 130 for the telephone company's lines or alternatively, as shown in FIG. 4, grommet openings 176 and 178 may also be utilized for the purpose of entering into the base member 70. opening 168 is provided with a rubber grommet 180 which protects a cable, not shown, entering the base member 70 by avoiding any friction between the wall 130 and base member 70, thereby assuring long term reliability of the base member 70. The base portion 124 includes additional vertical slotted posts 182, 184, 186, 188, 189, 191, 193 and 195 which may be utilized to mount either additional printed circuit boards or terminal connection assemblies 190, 192, 197 and 199 to ease in the wiring of the circuit components 202, 204, etc. incorporated in the restricted or shielded portion of the telephone network interface apparatus 10.

The mounting of the telephone network interface apparatus 10 may be accomplished by utilizing the extending brackets 194 and 196 provided on base member 70 which are provided with slotted apertures 198 and 200, respectively. The extending brackets 194 and 196 are integrally molded with the base member 70. Additionally, apertures 202, 206, 208 and 210 may be also used to affix, in a conventional manner, the telephone network interface apparatus to a flat, generally vertical surface.

In operation, if a problem were to occur on the telephone subscriber line, the house owner would remove plugs 110 or 114 from their respective sockets 112 and 116 and directly connect a known operating telephone instrument with its associated plug into socket 112 or 116. If the instrument operates properly then the trouble is in the homeowners wiring. If it does not operate then the trouble is with the telephone company's portion of the subscriber loop. In a like manner, the other subscriber line may also be checked.

Hereinbefore, has been disclosed a compact telephone network interface apparatus providing limited access to the contents thereof for a subscriber while permitting complete access to the contents thereof by a telephone company employee so that he may readily service and make connections thereto.

It will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. In a telephone network interface housing providing limited access to the owner of premises and providing complete access by telephone service employees having an open top base member with a circumscribing wall portion and a telephone subscriber loop termination disposed therein, the improvement comprising a hinged cover for said open top base member, wherein said hinged cover is free from apertures communicating with the inside of said open top base member.

2. A telephone network interface apparatus comprising:

A. a base member means of a telephone network interface apparatus has an open top and a circumscribing wall portion for receiving electrical components in the interior thereof with a telephone subscriber loop termination disposed therein; and B. a hinged cover member attached to said base member means for cooperating with said base member means by covering said base member means open top, said cover member being free from apertures communicating with the interior of said base member means, said hinged cover member provides limited access to the owner of the premises and provides complete access by telephone service employees.

3. A telephone network housing interface according to claim 2, further comprising:

a) said open top base member circumscribing wall portion including at least two outwardly extending C-shaped portions for receiving an elongated bar member in the open portion thereof;

b) a first and second set of terminals disposed in said base member, said first set of terminals being adapted to be connected to the premises owner's subscriber loop termination and said second set of terminals being adapted to be connected to the telephone company owned portion of said subscriber loop;

c) mating plug and socket members disposed in said base member having electrical contacts therein adapted to be electrically and mechanically engaged and disengaged with each other;

d) first means for electrically connecting said plug means to said first set of terminals and second means for electrically connecting said socket to said second set of terminals; and e) said hinged cover means being provided with, i) at least two outwardly extending bar members adapted to be received by and cooperate with said outwardly extending C-shaped portions to provide said cover for said open top base member, ii) said extending bar members including at least one longitudinally extending protrusion, and iii) hinged shield means, said shield means being provided with means for receiving and cooperating with said bar members' extending protrusion and having a portion adapted to cover at least said second set of terminals but not said first set of terminals.

4. A telephone network interface apparatus according to claim 3, wherein said hinged shield means additionally covers overvoltage devices disposed within said base member means.

5. A telephone network interface apparatus according to claim 3, wherein said hinged shield means additionally covers additional circuitry disposed within said base member means.

6. A telephone network interface apparatus according to claim 2, wherein said base member means is provided with a plurality of slotted post members adapted to receive printed circuit board members therein.

7. A telephone network interface apparatus according to claim 3, wherein said base member means wall portion is provided with an opening communicating with the inner portion of said base member means providing access for electrical wires to be connected to said terminals therethrough.

8. A telephone network interface according to claim 3, wherein said first and said second electrically connecting means is a set of electrical conductors.

9. A telephone network interface according to claim 3, further including first and second locking means, said first locking means locking said hinged shield means to said base member means and said second locking means locking said cover member to said shield means.

10. A telephone network interface according to claim 9, wherein said first and second locking means are unlike.

11. A telephone network interface according to claim 10, wherein said first looking means incudes extending lip portions provided on said base member means and said shield means and said second locking means includes extending lip portions provided on said hinged shield means and said cover member.

12. A telephone network interface according to claim 3, wherein said mating plug and socket members are disposed within said base member means and are not covered by said hinged shield member.

13. A telephone network interface according to claim 3, wherein said first set of terminals is provided with a skirt means, said skirt means extending to contact a downwardly extending portion provided on said hinged shield means to prevent access to the shielded portion of said base member means.

14. A telephone network interface according to claim 3, wherein said base member means is provided with a plurality of slotted posts for receiving printed circuit boards upon which are disposed a plurality of components, terminals and connectors.

15. A telephone network interface according to claim 3, wherein said hinged shield means cover portion is free from apertures communicating with the inside of said open top base member means.

* * * * *